US005730281A

United States Patent [19]

Powell et al.

[11] Patent Number: 5,730,281

[45] Date of Patent: Mar. 24, 1998

[54] COMPACT PACKAGE FOR A CANOPY KIT MADE UP OF ELONGATED PIPES AND CORNER CONNECTORS

[75] Inventors: Billy R. Powell, Holly Springs; David R. Powell; Tony A. Powell, both of Fuquay-Varina, all of N.C.

[73] Assignee: Powell & Powell Supply Inc., Fuquay-Varina, N.C.

[21] Appl. No.: 651,237

[22] Filed: May 22, 1996

[51] Int. Cl.[6] ..... B65D 85/20; E04H 5/28

[52] U.S. Cl. ..... 206/223; 135/98; 135/136; 206/371; 206/443

[58] Field of Search ..... 206/223, 321, 206/443, 446; 135/98, 136

[56] References Cited

U.S. PATENT DOCUMENTS

| | | | |
|---|---|---|---|
| 2,044,659 | 6/1936 | Adams | 135/98 X |
| 2,151,908 | 3/1939 | Gottlieb | 135/136 |
| 2,182,283 | 12/1939 | Curtis | 135/136 |
| 2,730,259 | 11/1956 | Friek | 206/443 X |
| 2,835,406 | 5/1958 | Dickenson | 206/446 X |
| 2,860,772 | 11/1958 | Northington, Jr. et al. | 206/321 X |
| 2,908,121 | 10/1959 | Enos, Jr. | 206/443 X |
| 3,332,551 | 7/1967 | Peterson | 206/321 |

*Primary Examiner*—Bryon P. Gehman

*Attorney, Agent, or Firm*—Rhodes, Coats, & Bennett, LLP

[57] ABSTRACT

The present invention relates to a canopy kit comprising a plurality of elongated pipes and a series of corner connectors and a package for containing the various kit components. An elongated container is provided and the various components of the kit, including the corner connectors and pipes, are disposed within the container such that the components of the kit structurally reinforce the total package and wherein the individual corner connectors are strategically disposed throughout the package so as to support the elongated pipes.

24 Claims, 12 Drawing Sheets

COMPACT PACKAGE FOR A CANOPY KIT MADE UP OF ELONGATED PIPES AND CORNER CONNECTORS

FIELD OF THE INVENTION

The present invention relates to packaging and more particularly to a package for containing various components that can be erected into an elevated canopy.

BACKGROUND OF THE INVENTION

Elevated canopies are now being sold and used widely. Typically, these canopies include a series of vertically oriented support posts that support an overhead open frame structure from opposite sides. The overhead frame structure or roof frame is designed to accept a tarp. The tarp is effectively secured to the overhead frame structure by a series of elastic tie cords.

Kit-type canopies like that described above, are generally sold in an unpackaged form. That is, the various components that comprise the kit such as elongated pipes and corner connectors, are handled or bagged loosely. Obviously, the loose packaging of such a product makes the product as a whole difficult to promote, market and merchandise.

Therefore, there is a need for a package design that would accommodate a kit-type canopy of the type having a series of elongated pipes, corner connectors, and tarps.

SUMMARY AND OBJECTS OF THE INVENTION

The present invention entails a package containing a canopy kit made up of a series of elongated pipes and a series of corner connectors for connecting the respective elongated pipes. In addition, the package is provided with a tarp that forms the top of the canopy kit and an array of elastic tie cords for securing the tarp to the upper roof frame structure of the canopy kit.

The package structure of the present invention entails an elongated container having a bottom, a pair of side walls, a pair of end walls and a top. A series of corner connectors are longitudinally spaced in the package and each corner connector includes a series of arms projecting therefrom. These corner connectors when disposed within the container define an internal support structure within the package itself. A series of elongated pipes are disposed over the corner connectors and supported thereby.

In addition to the above, the formed package structure can contain additional corner connectors that are disposed over the elongated pipes within the package. These additional corner connectors include arms that extend transversely over the top of the elongated pipes and additional arms that extend downwardly between the side walls of the container and the pipes so as to generally isolate the pipes from the side walls of the container.

In a particular embodiment of the present invention, a series of corner connectors are longitudinally spaced throughout the elongated container. The various corner connectors form a series of transversely extending arms that extend transversely across the container. In addition, the same corner connectors include an array or series of vertically extending arms that extend upwardly adjacent an inner side of the side wall. Thus, the corner connectors form a three-sided disjointed open top frame structure for receiving a series of elongated pipes. The elongated pipes are laid into the container such that the pipes are supported over the transverse arms of the corner connectors while the vertically oriented arms extend adjacent the side walls of the container generally confine the pipes within the container from actually engaging the side walls of the container.

Also, the packaged canopy kit structure of the present invention includes a tarp and an array of elastic tie connectors or cords.

It is therefore an object of the present invention to provide a compact package structure for containing the individual components of a kit for a canopy.

Still a further object of the present invention resides in the provision of a package structure for the components of a canopy kit wherein the components are packaged in such a manner that the components themselves structurally reinforce the total package.

Other objects and advantages of the present invention will become apparent and obvious from a study of the following description and the accompanying drawings, which are merely illustrative of such invention.

BRIEF DESCRIPTION

DETAILED DESCRIPTION OF THE INVENTION

Figure 1:
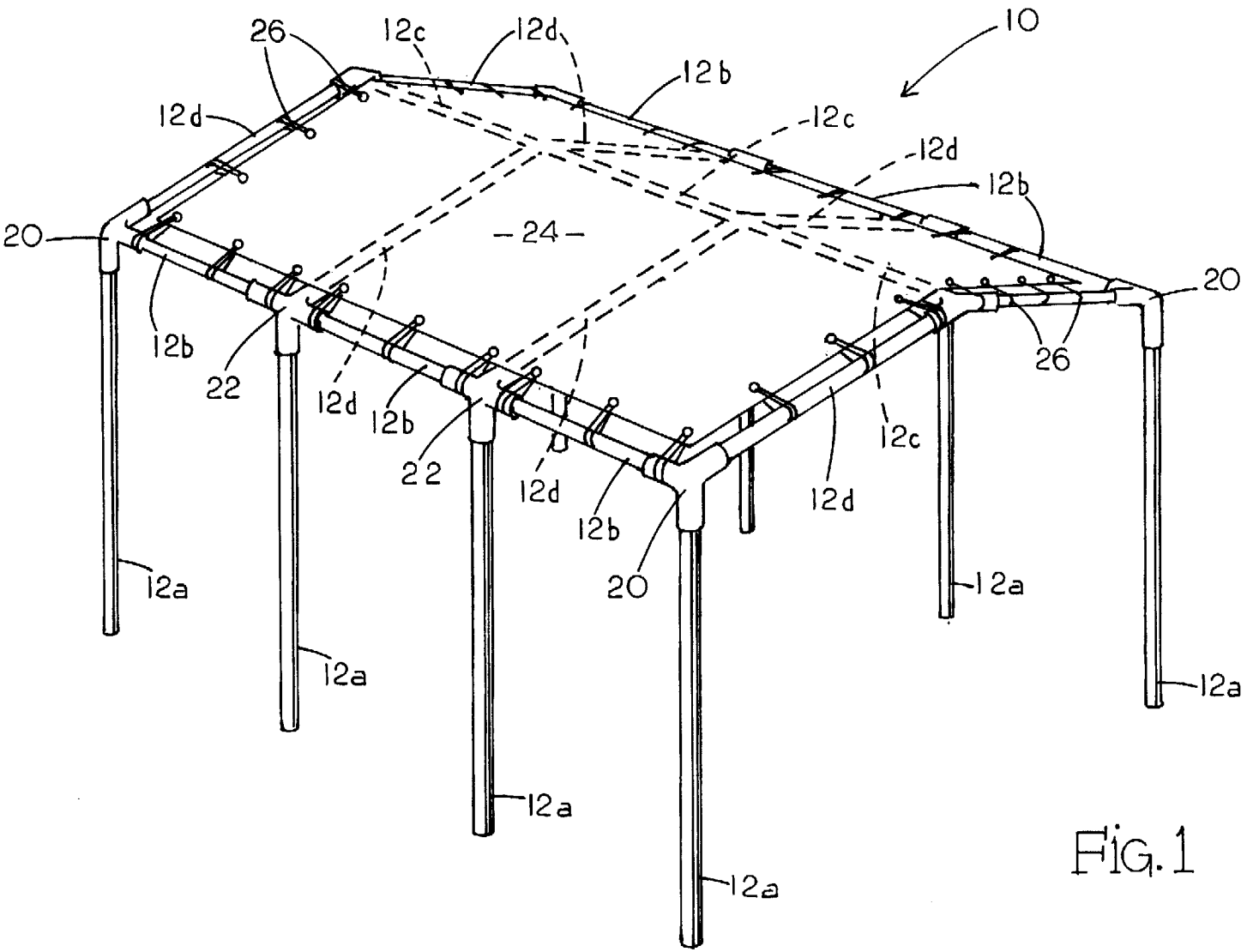
FIG. 1 is a perspective view of the canopy structure of the present invention shown erected.

With further reference to the drawings, particularly FIG. 1, an erected canopy is shown therein and indicated generally by the numeral 10. Canopy 10 is of the type that is customarily manufactured and sold as a kit, with the kit including a series of component parts.

The present invention relates to a package structure for housing and containing the component parts of the canopy 10. However, before discussing the package structure of the present invention, it may be beneficial to briefly review the key components of the canopy 10 shown in FIG. 1.

First, the canopy 10 includes a series or group of pipes 12. The group of pipes 12 includes a series of vertical support posts **12*a*, side members 12*b*, ridge members 12*c* and rafter members 12*d*. Posts 12*a* typically comprise elongated metal pipes. As seen in FIG. 1, when the canopy 10 assumes an erect mode, the vertical posts 12*a*** serve to support an overhead top frame or roof frame structure.

Viewing the top frame or roof frame structure of the canopy kit, it is seen that the same includes the series of side members **12*b*, a plurality of ridge members 12*c*, and a series of rafter members 12*d*. The side members 12*b*, ridge members 12*c* and rafter members 12*d*** are also constructed of elongated metal pipe.

To connect the various components to the top frame and to connect the top frame to the vertical post **12*a*, there is provided a series of corner connectors. First, there is provided a group of three-way corner connectors 20. Each of the three-way corner connectors includes arms 20***a*, 20*b*, and 20*c* that project outwardly from a formed joint. Also provided is a series of four-way corner connectors 22. The four-way corner connectors 22 include a series of arms 22*a*, 22*b*, 22*c* and 22*d*, that project outwardly from a central joint. Corner connector is used herein to denote a component of the canopy kit and means a connector having at least two arms for interconnecting two pipes together. The corner connector can be located at any location on an erected canopy.

Also provided with the canopy kit is a tarp 24 that is of a poly or vinyl type. An array of elastic tie cords 26 is also provided and these tie cords function to tie the tarp 24 to various components of the top frame.

Various sized canopies can be configured. For example, a canopy can measure 10 ft. ×20 ft. or 10 ft.×10 ft. Other sizes can obviously be offered.

Now, turning to the package structure of the present invention, the canopy kit of the present invention is packaged within a cardboard container indicated generally by the numeral 40. Package 40 includes a bottom 42, a pair of side walls 44 and a pair of end walls 46. There is provided a top 48 for enclosing the package 40.

Figure 2:
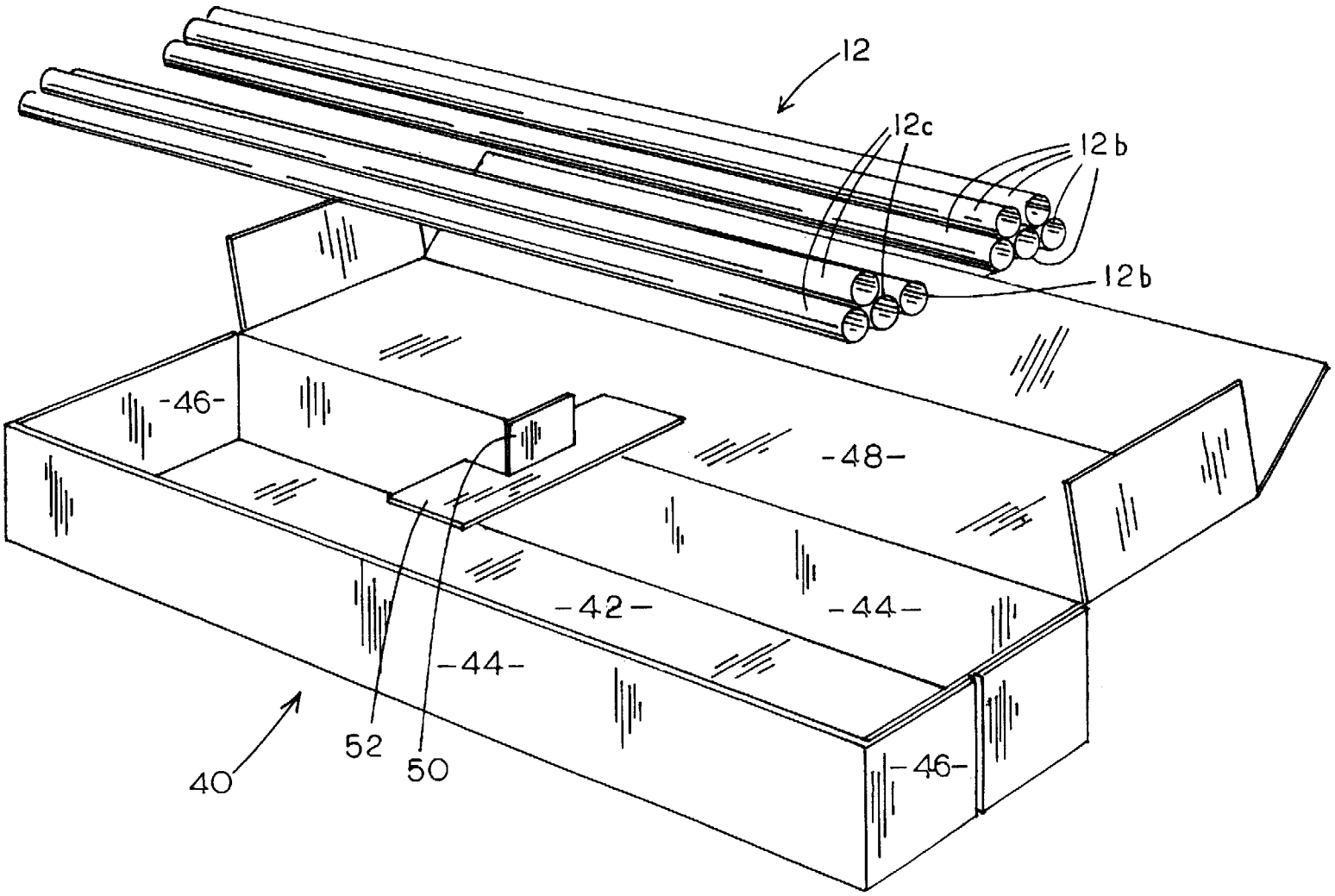
FIGS. 2–7 are a sequence of views illustrating the steps of packaging the container of the present invention.

Turning to one embodiment of the present invention, a sequence of views is shown in FIGS. 2–8 that show the basic steps involved in packaging the components of a canopy kit. Note in FIG. 2, that a divider panel is inserted into the package 40 and stationed on the bottom 42 midway between the end walls 46. This divider panel includes a base 52 and an upstanding divider wall 50. As shown in FIG. 2, a series of pipes 12*b* and 12*c* are placed on each side of the divider wall 50 such that the wall effectively separates the two groups of pipes.

Figure 3:
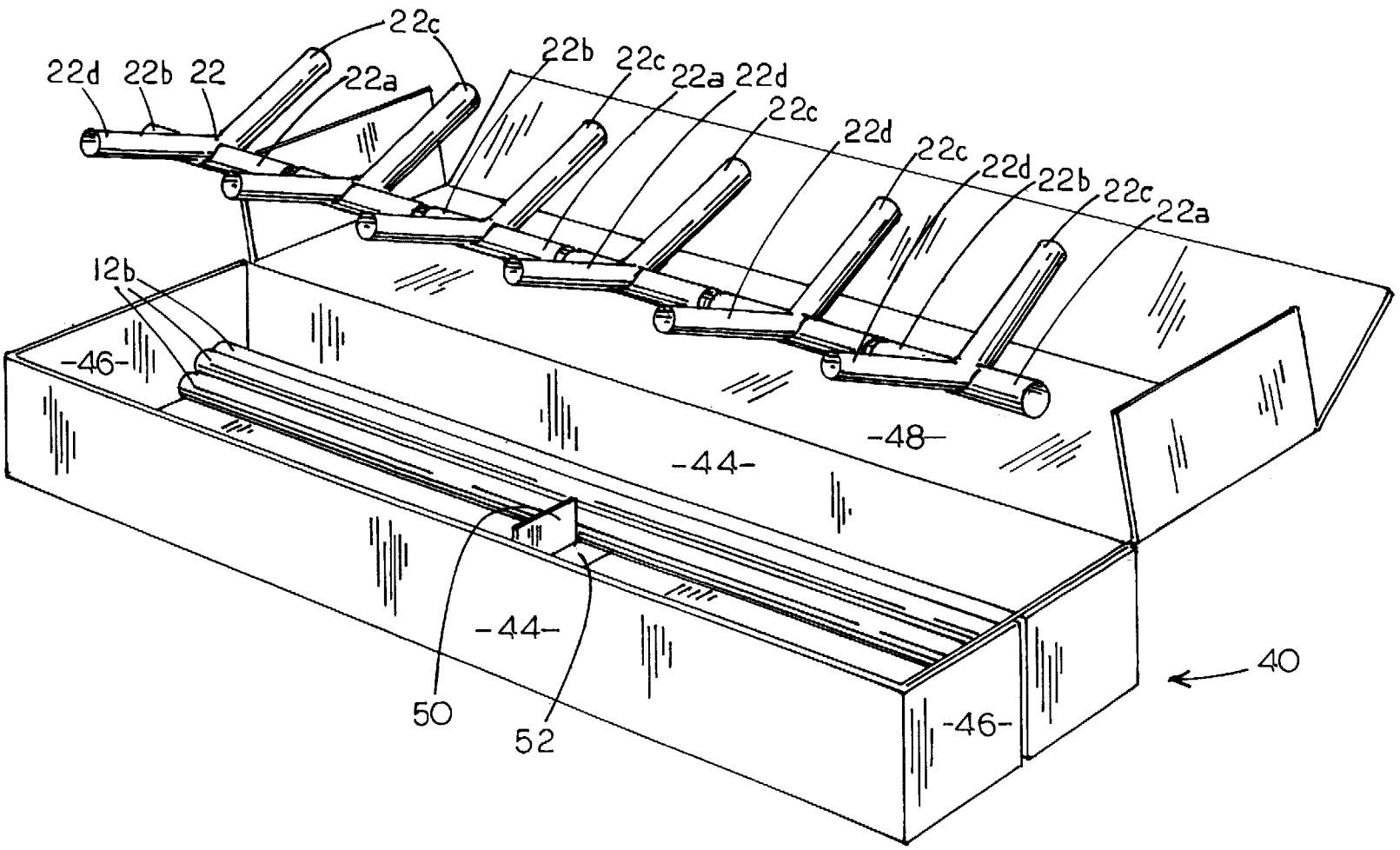
Figure 4:
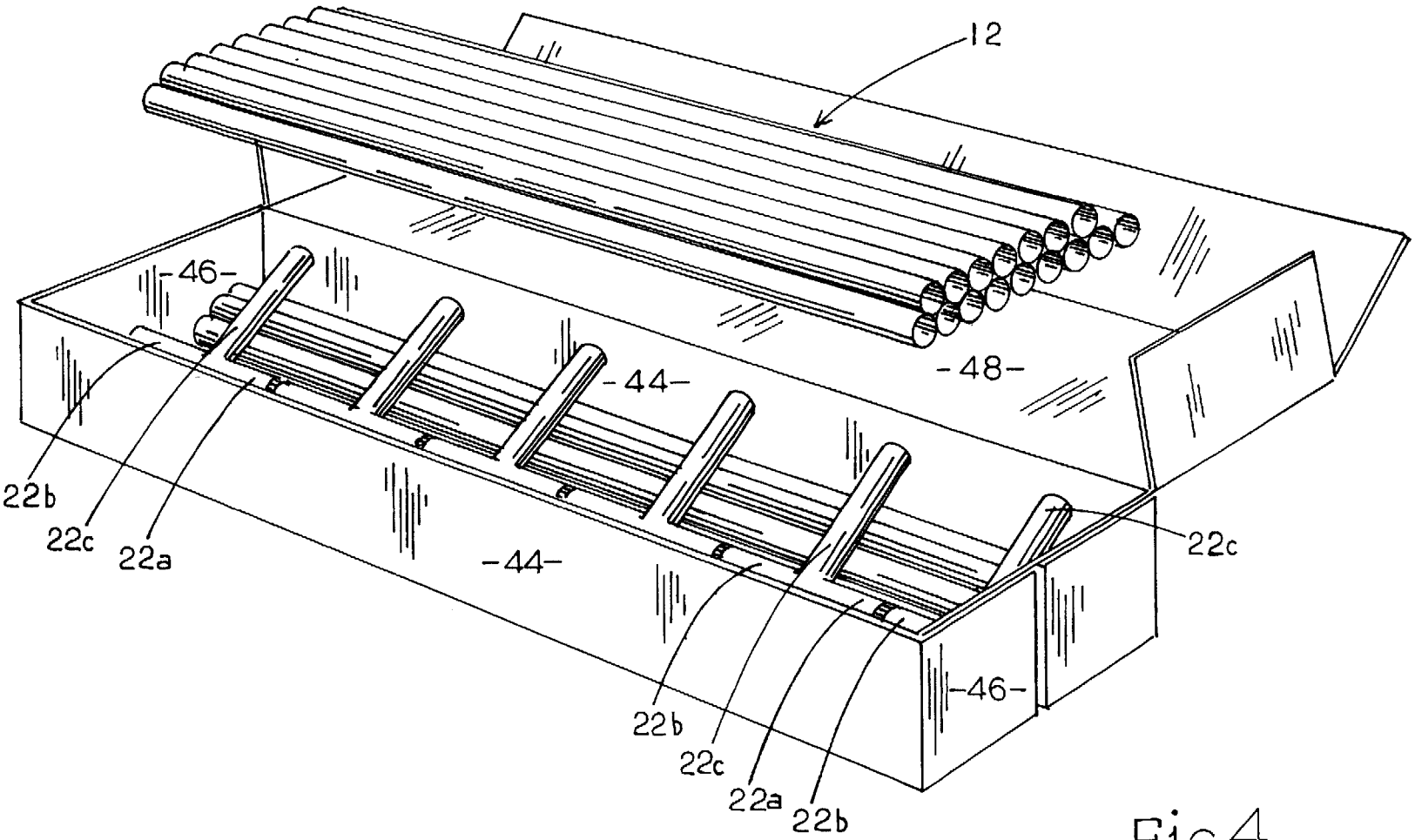

Next, as viewed in FIG. 3, a series of four-way corner connectors 22 are placed in the package 40. These four-way connectors 22 are longitudinally spaced. Note that the arms 22*a* and 22*b* are generally longitudinally aligned while arms 22*c* and 22*d* extend transversely across the container 40. Transversely oriented arms 22*c* and 22*d* tend to angle slightly upwardly from the axis formed by the longitudinally aligned arms 22*a* and 22*b*. Thus, arms 22*c* and 22*d* form an open V-shaped configuration or a shallow cradle structure.

The next step in the packaging process includes placing a series of pipes 12 (taken from the group of post and rafter members 12*a* and 12*d*) over the four-way corner connectors 22. See FIG. 4. Note that the transverse arms 22*c* and 22*d* form an open frame structure that underlies and supports the pipes 12 thereover.

Figure 5:
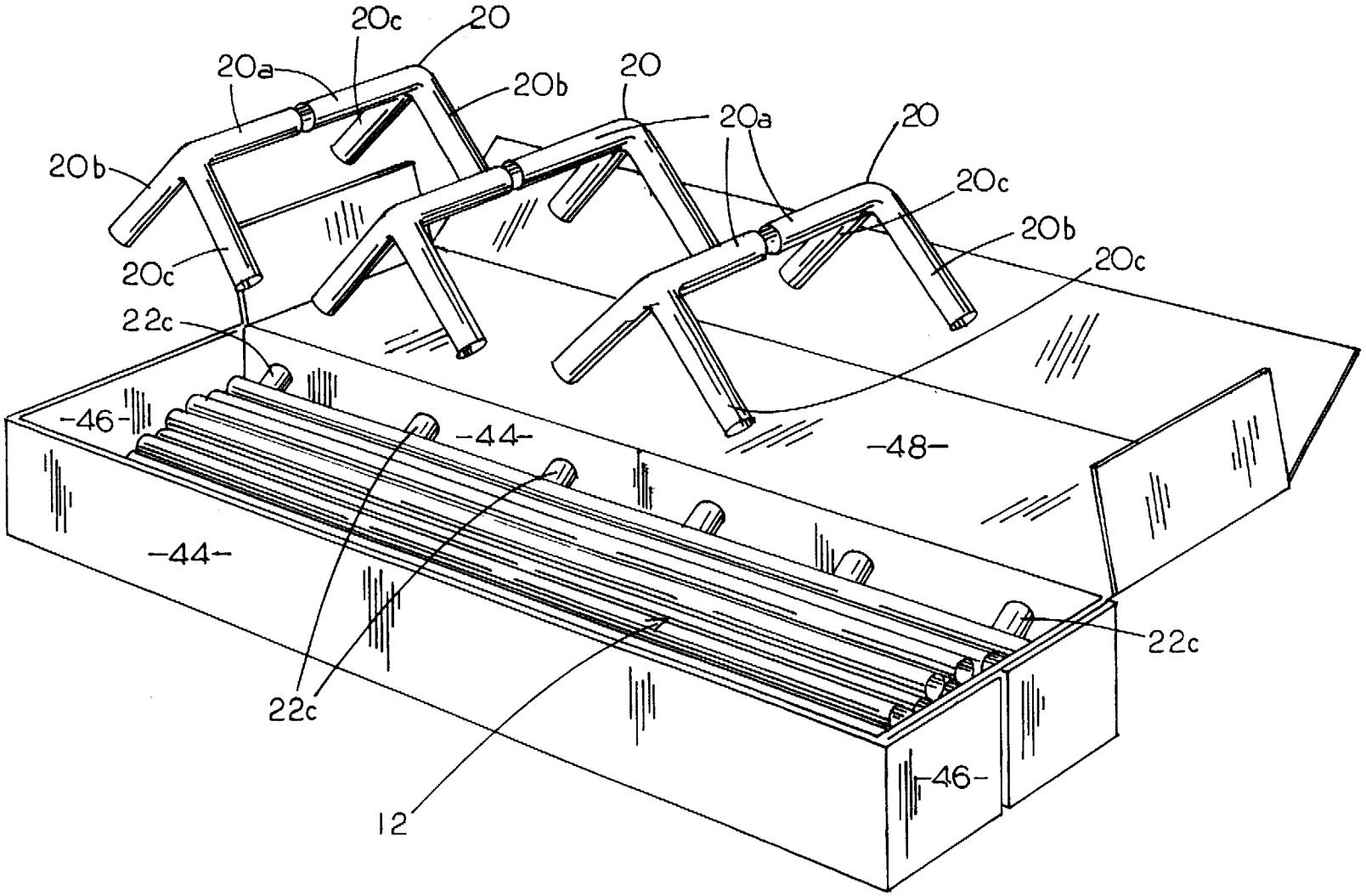
Figure 6:
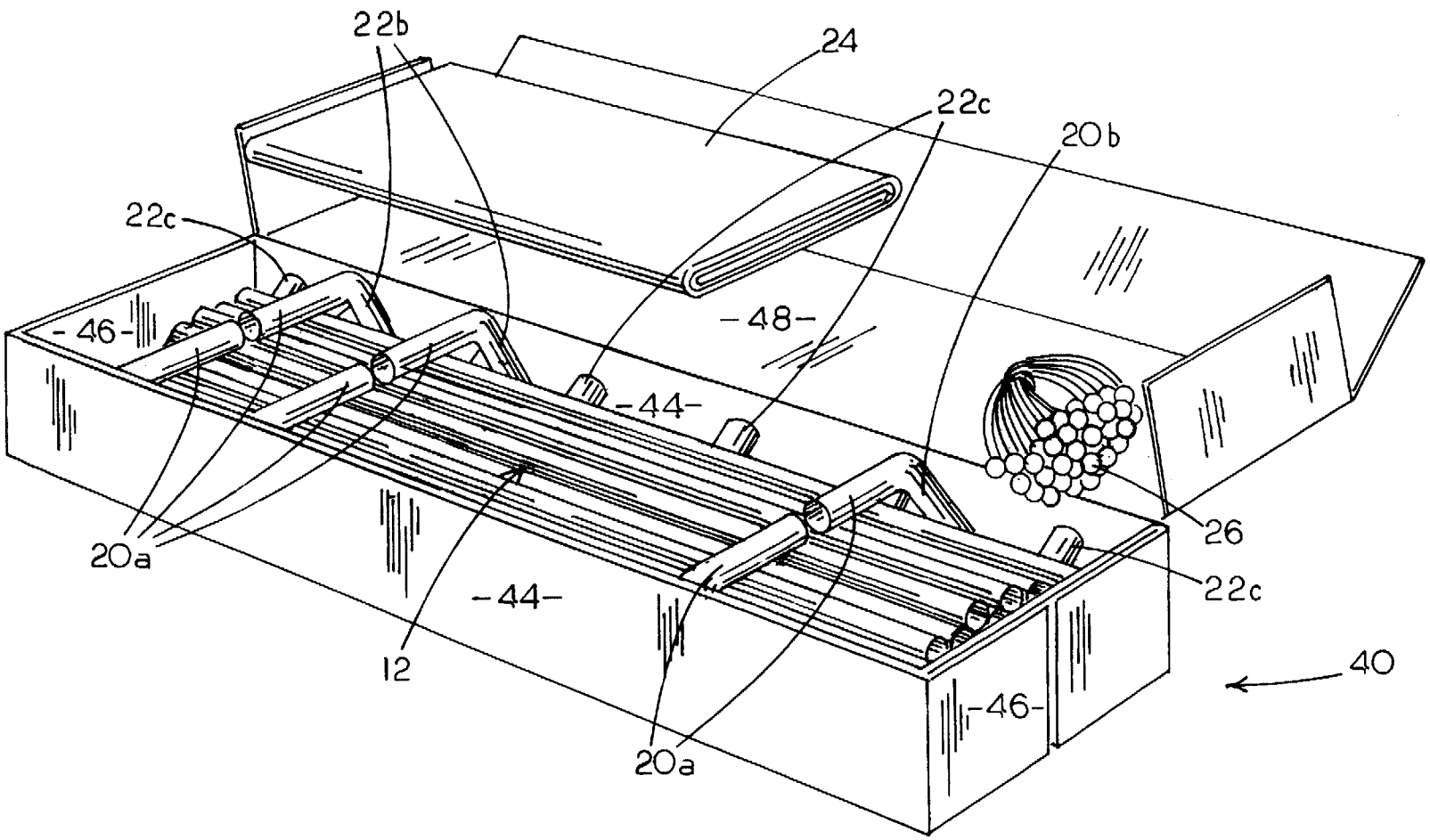
Figure 7:
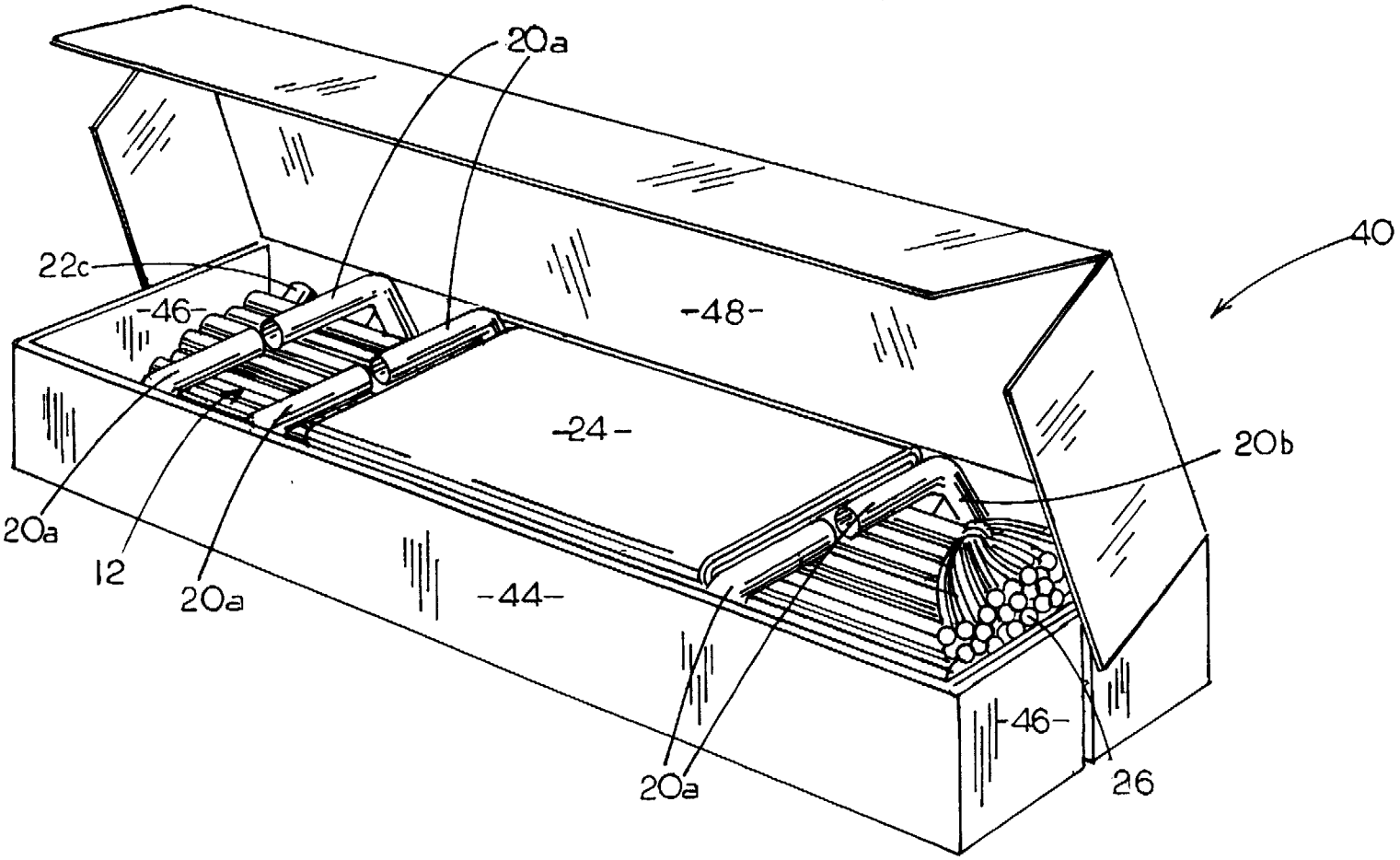

Next, the three-way corner connectors 20 are disposed over the pipes as shown in FIG. 5. Note that the three-way corner connectors 20 are placed in the package 40 in opposed relationship. That is, the three-way corner connectors 20 are disposed in generally aligned pairs which are longitudinally spaced through the package. In particular, along each side of the package 40, there is provided a plurality of three-way connectors 20. Note that arm 20*a* extends cross the top of the pipes 12 and terminates generally midway of the container. Extending generally along the side walls 44 of the package 40 are the other two arms 20*b* and 20*c* of the three-way connector. In particular, arms 20*b* and 20*c* extend downwardly between the pipes 12 that rest on the four-way connectors 22 and the side wall 44. Effectively, arms 20*b* and 20*c* separate the adjacent pipes 12 from the side walls Next, the container is provided with a tarp 24 and the elastic tie cords 26 (FIG. 6).

Figure 8:
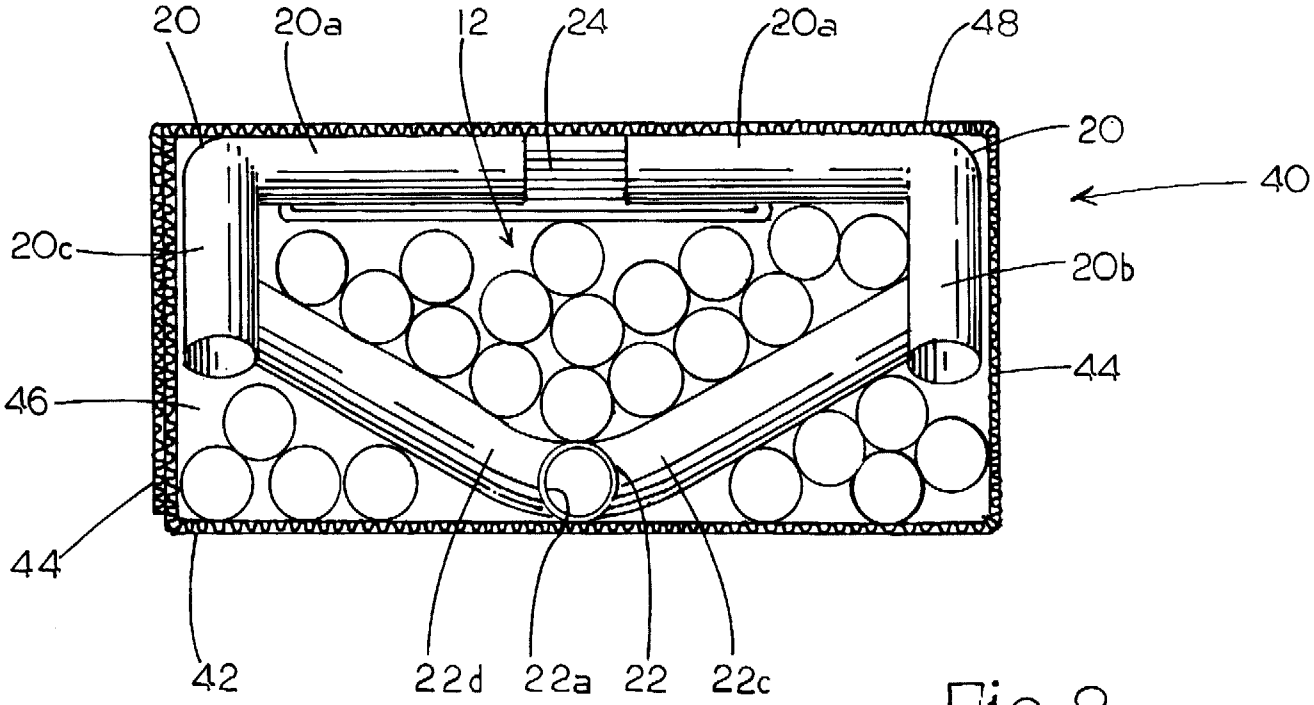
FIG. 8 is a cross-sectional view of the package shown in FIG. 7.

As seen in the drawings, the four-way corner connectors 22 in combination with the three-way corner connectors 20, form an open disjointed frame around the mass of pipes 12 supported the four-way corner connectors 22. Effectively, the three-way corner connectors 20 and the four-way corner connectors 22 form a frame structure around the upper group of pipes 12 supported by the four-way connectors and generally prohibit the upper group of pipes 12 from coming into contact with either the bottom 42 of the package or the side walls 44 of the package (FIG. 8).

In the package just described (FIGS. 2–7), the pipes disposed adjacent the bottom 42 include nine side and ridge member pipes 12*b* and 12*c* that in the embodiment illustrated, are approximately 6 ft. 6 in. long each. The nine pipes are divided by the divider wall 50, that is four pipes are on one side and five pipes on the other. Disposed over the four-way corner connectors 22 is a group of sixteen pipes. These pipes include the vertical posts 12*c* and the rafter member pipes 12*d*. In the embodiment illustrated, it is contemplated that the package would be approximately 8½ inches wide, 15 inches high, and 79 inches long.

Figure 9:
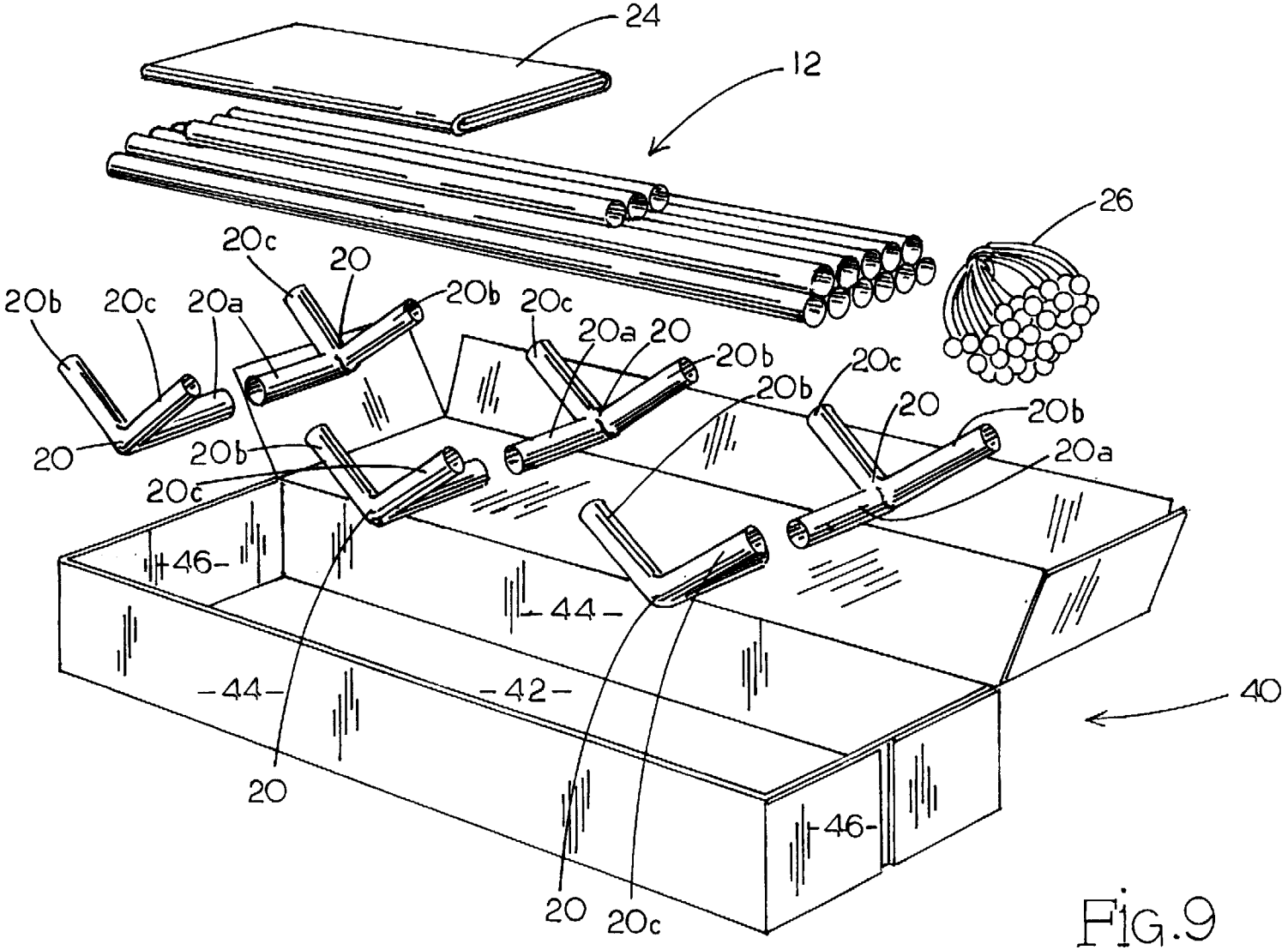
FIG. 9 is a perspective exploded view of a second package design for the canopy kit of the present invention.
Figure 10:
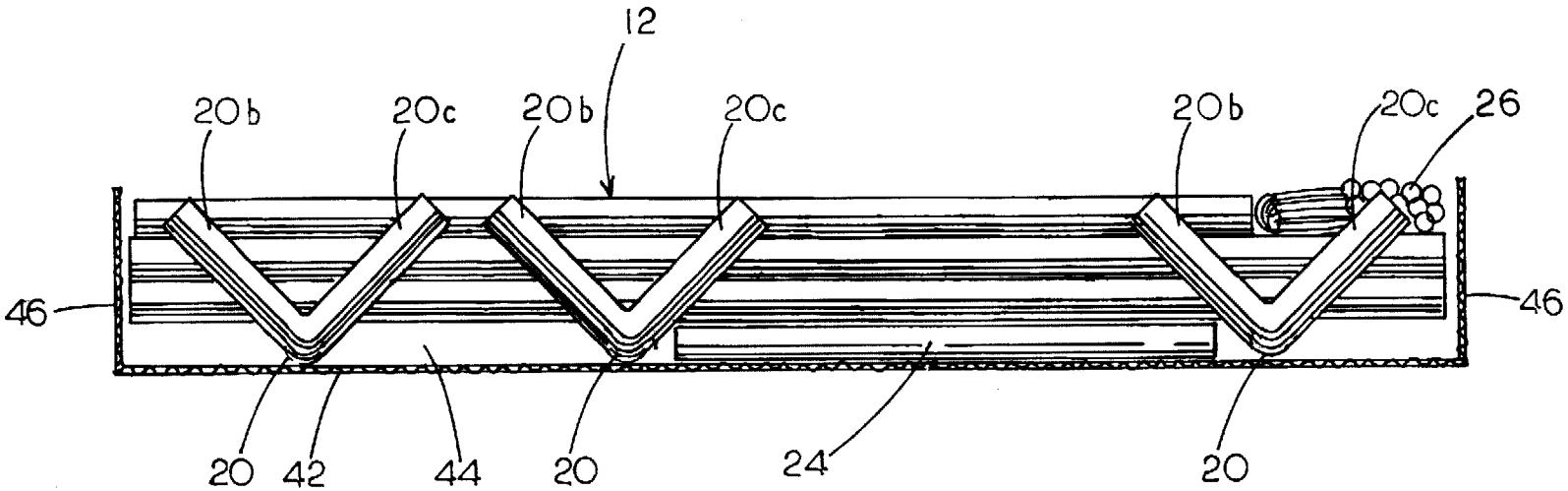
FIG. 10 is a side elevational view of the second package design with a near side wall and a top portion of the container being removed to better illustrate the packaging of the canopy kit components.
Figure 11:
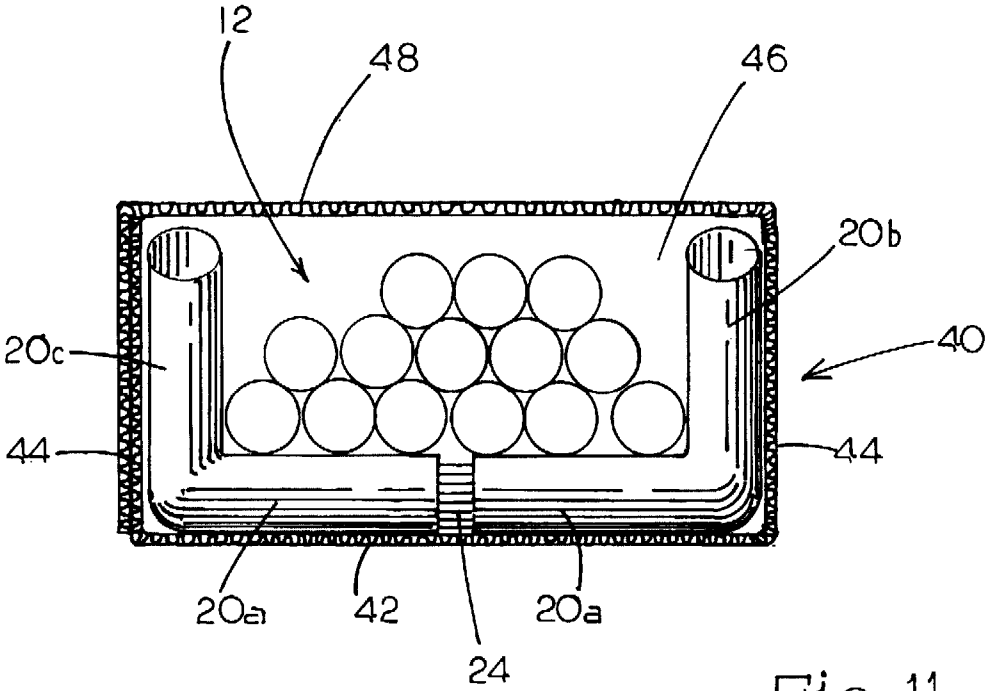
FIG. 11 is a cross-sectional view of the second package design.

Now, turning to a second package structure as shown in FIGS. 9–11, it is seen that the base of the package structure comprises a series of three-way corner connectors 20 longitudinally spaced along the bottom 42 of the package. The three-way corner connectors 20 are aligned transversely in pairs. In particular, one arm 20*a* of each three-way connector extends transversely across the package while there is an adjacent arm 20*a* from an opposed three-way connector 20 that extends adjacent the same. The remaining arms 20*b* and 20*c* of each three-way connector 20 extends upwardly from the bottom in a V-shaped configuration adjacent respective side walls 44. In the embodiment illustrated in FIGS. 9–11, there is provided six three-way corner connectors 20, three on each side of the package.

Next, after the three-way corner connectors have been placed in the container, a series of pipes 12 are laid over the transverse arms 20*a* of the respective three-way corner connectors 20. In the case of the embodiment illustrated, there are a total of fourteen elongated pipes 12 laid over the transverse arms 20*a*. Note that the three-way connectors 20 form a generally U-shaped, open and disjointed frame structure within the package. As seen, the pipes 12 contained within the open disjointed frame formed by the three-way connectors 20 are isolated from the bottom 42 and side walls 44 of the package.

As with the first package embodiment described above, the package 40 shown in FIGS. 9–11 is provided with a tarp 24 and a series of elastic tie cords 26. It should be noted that the tarp 24 could be placed on top of the package. As shown in FIGS. 10 and 11, the tarp 24 is disposed on the bottom 42 of the package.

The canopy kit package as described immediately above, basically includes six three-way corner connectors 20 and fourteen elongated pipes. This forms a 10×10 canopy. Packaged, the container is of a size of approximately 11 inches wide, 6 ½ inches high and 70 inches long.

It is appreciated that the various components for a canopy kit can vary in size, number, type, etc. As seen from the drawings, the various corner connectors 20 and 22 form an open disjointed frame structure for housing a substantial number of elongated pipes. This disjointed open frame structure tends to isolate the pipes 12 from portions of the cardboard container 40.

In the above discussion, two different package designs have been discussed for two separate canopy kits. It is appreciated that the package structure disclosed herein would be suitable for other canopy kits of various designs and sizes.

Figure 12:
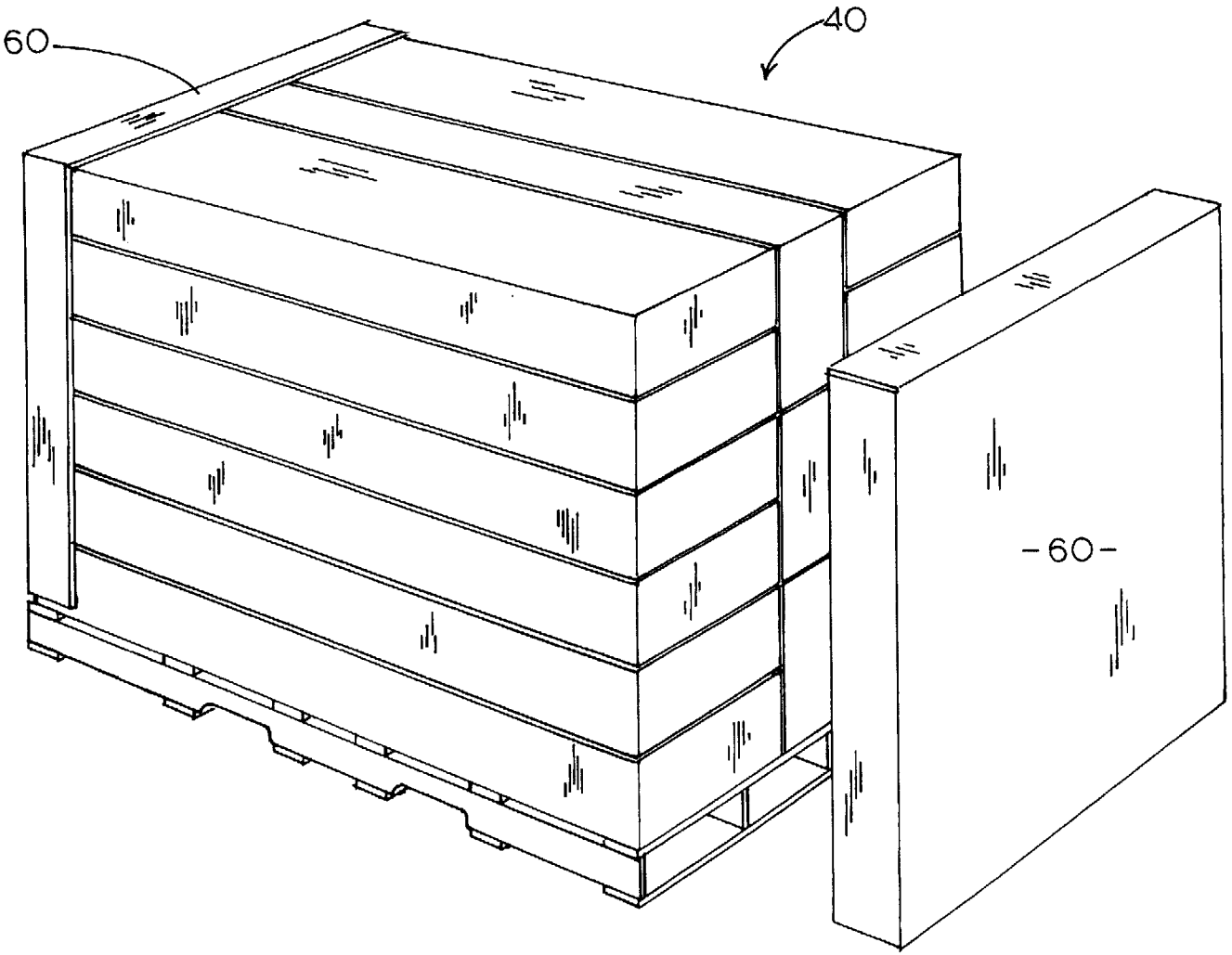
FIG. 12 is a perspective view showing how a series of packages are stacked and supported.

As illustrated in FIG. 12, individual packages 40 can be stacked on a palette and stabilized by a pair of end caps 60. Note that the end caps 60 are preferably formed of a cardboard structure and are secured around the ends of the respective packages 40 by staples or the like. This effectively tends to unitize a series of packages 40, causing them to be stabilized during transport and storage. In the end, the group of packages 40 can be displayed at a merchandising site while still on a palette or other support structure by simply removing or tearing away the pair of end caps 60.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A package for containing a canopy kit having a series of canopy elongated pipes and a series of canopy corner connectors for connecting the elongated pipes; the package comprising:

a) an elongated container having a bottom, a pair of side walls, a pair of end walls, and a top;

b) a series of canopy corner connectors longitudinally spaced in the package, each corner connector having a plurality of arms projecting therefrom and defining an internal support structure within the package;

c) a series of elongated canopy pipes disposed within the container and extending over the spaced apart canopy corner connectors such that the corner connectors underlie the elongated canopy pipes and support the canopy pipes within the container; and d) wherein the container itself including the bottom, side walls, end walls and top is independent of the canopy corner connectors and canopy elongated pipes as the corner connectors and elongated pipes are confined within the container and do not form a part of the bottom, side walls, end walls or top of the container.

2. The package of claim 1 wherein selected arms of the corner connectors extend transversely across the container and underlie and support the elongated pipes.

3. The package of claim 2 wherein respective corner connectors include four arms and wherein two of the arms are generally longitudinally aligned with the container while two of the arms extend transversely across the container.

4. The package of claim 3 wherein the two arms that extend transversely across the container extend outwardly and at least slightly upwardly above the bottom of the container.

5. The package of claim 4 wherein the arms extending transversely across the container form a cradle structure for receiving and holding the elongated pipes.

6. The package of claim 1 wherein respective corner connectors include three arms with one arm extending transversely across the container for supporting pipes thereover and two arms extend upwardly adjacent a side wall.

7. The package of claim 6 wherein respective corner connectors are oriented such that the vertically oriented arms extend adjacent each side of the container so as to define a pipe receiving space therebetween so as to protect the side walls of the container from the pipes held between the vertically oriented arms.

8. The package of claim 1 wherein the respective corner connectors include at least three arms and form an elongated channel support structure throughout the container.

9. The package of claim 8 wherein the elongated channel support structure includes a series of arms longitudinally spaced and extending transversely across the container and another series of arms that extend in a generally vertical plane adjacent the respective side walls of the container.

10. The package of claim 1 including a divider panel disposed on the bottom of the container, and a plurality of pipes disposed below the corner connectors and separated by the divider panel.

11. The package of claim 1 including a second series of pipes supported over the bottom of the container and underneath the corner connectors.

12. The package of claim 1 including a series of upper disposed corner connectors situated over the pipes, each corner connector having at least three arms and being longitudinally spaced such that one arm extends transversely over the pipes and wherein two other arms are turned downwardly adjacent the side of the pipes and form a frame between adjacent side walls of the container and the pipes.

13. The package of claim 1 wherein the defined package forms a part of a group of canopy kit packages with the group of packages being stacked to form a group of packages, and wherein the group of packages are stabilized and secured together by a pair of end caps that extend across opposite ends of the group of packages and wherein the end caps are secured to at least one of the packages forming the group of packages.

14. A package canopy kit comprising:

a) an elongated container having a bottom, a pair of side walls, a pair of end walls, and a top;

b) a plurality of corner connectors for connecting a series of pipes together that form a part of the canopy kit, the corner connectors being longitudinally spaced in the container and each corner connector including at least one arm that extends transversely across the container and a pair of arms that extend in a generally vertical plane adjacent a respective side wall of the container;

c) wherein the orientation of the corner connectors in the container are alternated such that the pair of arms of the respective corner connectors extend adjacent both side walls of the container such that the respective arms of the corner connector form an open frame channel support throughout the container; and d) wherein the pipes of the canopy kit are disposed within the open type channel frame structure formed by the arms of the corner connectors such that the arms of the corner connectors generally support the pipes in an area spaced from the bottom and side walls of the container.

15. The package canopy kit of claim 14 including a cover disposed within the package canopy kit.

16. The package canopy kit of claim 15 further including elastic tie cords packaged within the container.

17. A canopy kit package containing a plurality of elongated pipes and a plurality of corner connectors for connecting the pipes together, comprising:

a) an elongated container having a bottom, a pair of side walls, a pair of end walls, and a top;

b) a first set of corner connectors longitudinally spaced in the container and forming a bottom frame structure above the bottom of the container;

c) a series of pipes disposed over and supported by the first set of corner connectors; and d) a second set of corner connectors longitudinally spaced in the containers with the second set of corner connectors including a series of arms that extend over the pipes and another series of arms that extend generally vertically between the pipes and the respective side walls of the container so as to generally separate the pipes from the side wall of the container.

18. The canopy kit package of claim 17 including a divider panel disposed across the bottom of the container and a second series of pipes underlying the first set of corner connectors and separated by the divider panels.

19. The canopy kit package of claim 18 including a tarp and elastic tie cords.

20. A method of packaging corner connectors and pipes that form components of a canopy kit in a container having a bottom, side walls, and end walls, comprising:

a) placing a series of corner connectors in the container;

b) orienting at least some of the corner connectors such that arms extending therefrom extend transversely across the container;

c) orienting at least some of the corner connectors such that arms extending therefrom extend adjacent the side wall of the container; and d) disposing a series of pipes in the container such that the pipes are supported over the arms of corner connectors extending transversely across the container and wherein at least some of the pipes are separated from the side wall of the container by the arms of corner connectors extending adjacent the side wall of the container.

21. The method of claim 20 wherein the arms that extend transversely across the container form a generally V-shaped open frame structure for supporting pipes.

22. The method of claim 21 wherein the arms that extend transversely across the container form a part of corner connectors having at least three arms with at least one arm of each such corner connector assuming a longitudinal direction with the corner connector.

23. The method of claim 20 wherein the arms of the corner connectors that extend transversely across the container extend at an angle generally perpendicular to the side walls.

24. The method of claim 23 wherein the arms that extend adjacent the side walls of the container form a part of the corner connectors having the arms that extend transversely across the container.

* * * * *